United States Patent [19]

Bisping et al.

[11] Patent Number: 4,895,055

[45] Date of Patent: Jan. 23, 1990

[54] INSTALLATION TOOL FOR AN ANCHOR ELEMENT

[75] Inventors: Heinz Bisping; Erich Leibhard, both of Munich; Peter Mauthe, Kleinberghofen, all of Fed. Rep. of Germany

[73] Assignee: Hilti Aktiengesellschaft, Fürstentum, Liechtenstein

[21] Appl. No.: 187,225

[22] Filed: Apr. 28, 1988

[30] Foreign Application Priority Data

Apr. 28, 1987 [DE] Fed. Rep. of Germany ..... 3714102

[51] Int. Cl.[4] ..... B25B 13/50

[52] U.S. Cl. ..... 81/53.2

[58] Field of Search ..... 87/53.2, 459

[56] References Cited

U.S. PATENT DOCUMENTS

| | | | |
|---|---|---|---|
| 2,775,153 | 12/1956 | Parhaniemi | 81/53.2 |
| 2,933,962 | 4/1960 | Logan | 81/53.2 |
| 3,199,721 | 8/1965 | Williams | 81/53.2 |
| 3,892,147 | 7/1975 | Flaig | 81/53.2 |
| 4,106,178 | 8/1978 | Seletyn | 81/53.2 X |
| 4,651,596 | 3/1987 | Rachanski | 81/53.2 |
| 4,684,138 | 8/1987 | Michaud | 81/53.2 X |
| 4,745,831 | 5/1988 | Nutt et al. | 81/53.2 |

FOREIGN PATENT DOCUMENTS

| | | | |
|---|---|---|---|
| 2134781 | 2/1979 | Fed. Rep. of Germany . | |
| 18142 | 9/1891 | United Kingdom | 87/53.2 |

OTHER PUBLICATIONS

Popular Mechanics Article; "A Tool to Drive Studs", 9/1931, p. 514, vol. 56 #3.

*Primary Examiner*—James G. Smith

[57] ABSTRACT

An installation tool for placing anchor elements includes an axially extending member and a ball with a thread on the member for engagement with the anchor element to be installed. The ball is captured in a receiving space in the installation tool and serves as a stop for limiting the threaded engagement of the tool with the anchor element. The ball has only a punctiform contact with the element, accordingly, the frictional engagement between the ball and the element developed while an anchor element is being screwed in is very small, so that the installation tool can be unscrewed easily from the anchor element after the element is installed.

6 Claims, 1 Drawing Sheet

INSTALLATION TOOL FOR AN ANCHOR ELEMENT

BACKGROUND OF THE INVENTION

The present invention is directed to an installation tool for threading-in anchor elements. The anchor elements are equipped with a thread at the end opposite the end facing the installation direction. The installation tool has a thread corresponding to the thread on the anchor element and a stop member limiting the threaded engagement of the installation tool with the anchor element Installation tools of the above type are known, such as the tool disclosed in DE-PS 2 134 718, used mainly for the placement of so-called adhesive or shear anchors. A threaded rod or a threaded sleeve is connected with the installation tool by means of threaded interengagement and the anchor is driven into a borehole, such as one containing a hardenable mass. The driving action occurs mostly while turning the installation tool, with such turning or rotation serving to destroy an anchor cartridge or for mixing components contained in the borehole. In part, the driving of the anchor takes place with the help of a rotary impact motion.

After the anchor has been inserted, the installation tool must be removed from the anchor, that is, it must be unscrewed which takes place only with considerable difficulty, since the threaded interengagement of the installation tool and the anchor is tightened during the step of installing the anchor. To release the tight connection, a stop in the form of an eccentric shaft in the installation tool must be turned by means of a wrench. If this step is omitted, then the anchor may again be removed from the borehole during the unscrewing operation.

SUMMARY OF THE INVENTION

Therefore, the primary object of the invention is to provide an installation tool for driving anchor elements into a receiving material so that, after the anchor element has been inserted, the installation tool can be easily removed from it.

In accordance with the present invention, a stop in the form of a sphere or ball is located in a receiving space in the installation tool with the space being open in the installation direction and with the axial extent of the space being smaller than the diameter of the sphere or ball.

Accordingly, the ball has a small point-shaped or punctiform contact with the anchor element, whereby no large frictional force interferes with the release or separation of the installation tool from the element. Moreover, a standard hardened element can be used as the balls which are economical and have a low tendency towards wear. The smaller axial dimension of the receiving space as compared to the diameter of the ball assures that the ball projects axially out of the receiving space and that the anchor element experiences only axial contact with the ball. The diameter of the end of the receiving space through which the ball projects is preferably smaller than the diameter of the ball. As a result, the ball is captured or secured in the receiving space and is retained within the installation tool in such a way that it cannot be lost. In a preferred arrangement, the ball is rotatably supported within the receiving space of the installation tool. Due to its rotatability, the ball can remain motionless when tightening the installation tool on the anchor element and it can turn with respect to the rest of the installation tool. Because of the point-shaped contact, the friction developed, which must be overcome when releasing the installation tool, is very small.

In a preferred embodiment, the receiving space for the ball is located at the leading end or installation direction end of a bolt-like member equipped with an external thread. Such a tool is used for installing threaded sleeves. The threaded sleeve has a bore and when the installation tool is inserted into the bore, the ball contacts the base of the bore. Due to this contact of the installation tool at the base of the bore in the anchor element, damage to the trailing end of the anchor element caused by the installation tool is avoided. Such an arrangement is advantageous especially if the anchor element is provided on its periphery and at the trailing face with a plastics coating serving for electrical insulation and/or corrosion protection.

In yet another preferred embodiment, the receiving space for the ball is located within the installation tool spaced inwardly from the leading end of the tool with a threaded bore located between the receiving space and the leading end or installation direction end. Such an installation tool is employed for the placement of threaded rods. Such a threaded rod is screwed into the threaded bore in the installation tool until the trailing end of the rod axially contacts the ball. The contact between the ball and the trailing end of the threaded rod is point shaped and centered within the bore.

To maintain the friction between the ball and the installation tool or between the ball and the anchor element, a cushion of grease can be provided in the receiving space enclosing the ball. Due to such a grease cushion, the entire surface of the ball is lubricated. Such an arrangement can further reduce the low sliding friction provided by the ball.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described the preferred embodiments of the invention.

DETAILED DESCRIPTION OF THE INVENTION

Figure 1:
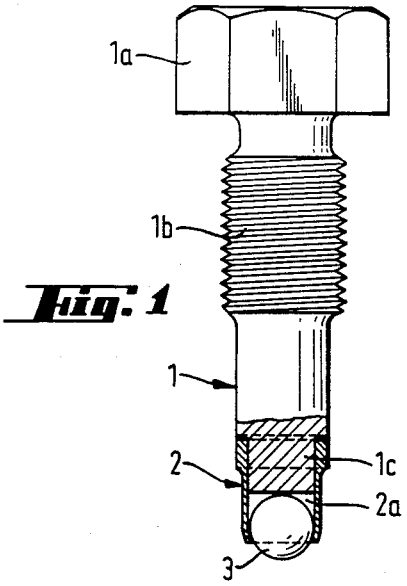
FIG. 1 is an elevational view, partly in section, of an installation tool embodying the present invention.
Figure 2:
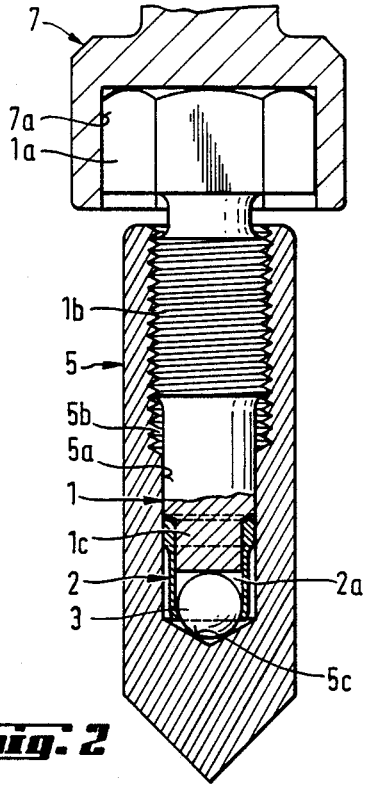
FIG. 2 is an elevational view similar to FIG. 1, shown partly in section, with the installation tool screwed into an internally threaded anchor sleeve with a power tool adapter engaged with the installation tool.

In FIGS. 1 and 2, an installation tool is shown formed of an axially extending, bolt-like member 1, an axially extending sleeve 2 at one end of the bolt-like member and a ball 3 secured within the sleeve. As viewed in FIGS. 1 and 2, the lower end of the installation tool is the first or leading end and the upper end is the second or trailing end. At its second end, the bolt-like member 1 has an hexagonal head 1*a* with a shank section extending axially from the head toward the first end. A thread 1*b* is formed on the shank extending from adjacent the head la toward but spaced from the leading end of the shank. At its leading end, the shank is stepped inwardly forming a lug 1*c* spaced axially from the thread 1*b*. Sleeve 2 is pressed onto the lug 1*c* and extends axially from the leading end of the lug so that the combination of the leading end of the lug and the inside surface of the sleeve form a receiving space 2*a* for the ball 3. The sleeve at the first end of the tool has an opening with a diameter smaller than the diameter of the ball 3, so that the ball is captured or retained within the receiving space 2*a* while being able to rotate.

In FIG. 2, the installation tool is in threaded engagement with an axially extending anchor element or anchor sleeve 5 which is to be installed by the tool. Anchor sleeve 5 has an axially extending bore 5*a* open at the second end or trailing end of the sleeve. The inner surface of the sleeve 5 adjacent the trailing or second end has an internal or female thread 5*b* corresponding to the thread 1*b* on the boltlike member 1. The installation tool is threaded into the anchor sleeve 5 until the ball 3 at its front end contacts the base 5*c* of the bore 5*a* and serves as an axial stop. With the ball 3 rotatably captured in the receiving space 2*a*, it will remain motionless because of the higher frictional force with the anchor sleeve during the tightening operation. Accordingly, a rotary motion is formed at the point-shaped contact of the ball 3 at the first end of the bolt-shaped member 1. As a result, the friction developed is very low. As shown in FIG. 2, the hexagonal head 1*a* of the bolt-like member 1 is inserted into a hexagonal opening 7*a* in an adapter 7. Adapter 7, shown only in part, can be turned manually or by a mechanical screw setting device or a power drill (not shown). Adapter 7 can be used with different installation tools with different threads as long as the tool has the same hexagonal head.

Figure 3:
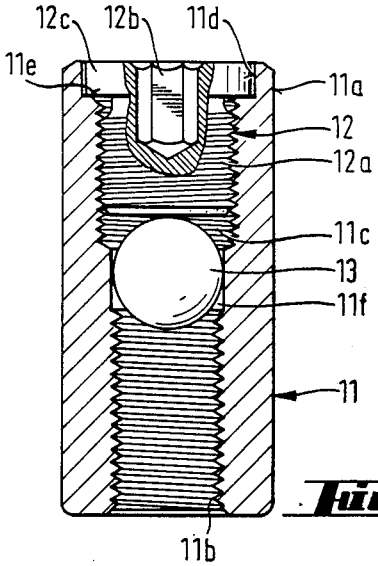
FIG. 3 is an elevational view, partly in section, of another embodiment of the installation tool of the present invention utilized for the installation of threaded rods.
Figure 4:
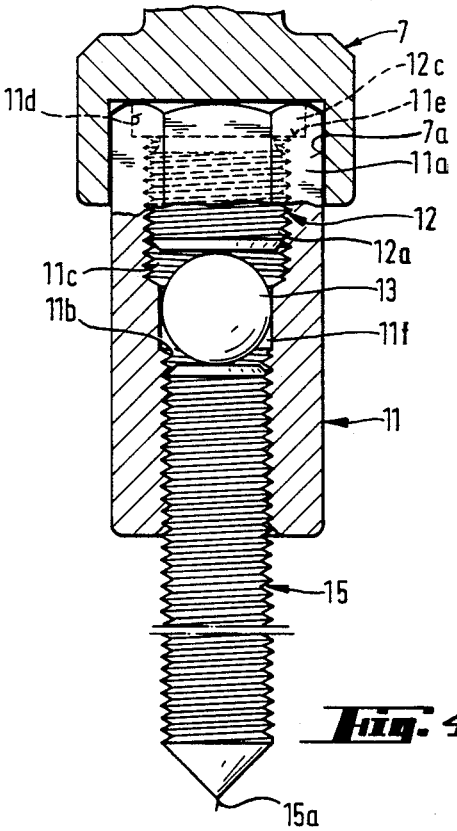
FIG. 4 is an elevational view similar to FIG. 3, shown partly in section, with the threaded tool in threaded engagement with a threaded anchor rod and with a power tool adapter engaging the installation tool.

In FIGS. 3 and 4, another installation tool embodying the present invention is illustrated and includes an axially extending bushing 11 having a first or leading end, that is, the lower end in FIGS. 3 and 4 and a second or trailing end, that is, the upper end in the figures. At its second end, the bushing has an axially extending hexagonally shaped surface 11*a*, a sealing screw member 12 insertable into the bushing 11 and a ball 13. Bushing 11 has a threaded bore 11*b* extending from its first end for a portion of the axial length of the sleeve and another larger internal thread 11*c* extending from the second end of the bushing toward the first end. At the trailing end, a cylindrical counterbore 11*d* is formed extending between the trailing end of the thread 11*c* and the second end. The counterbore 11*d* forms an annular shoulder surface 11*e* extending transversely of the axis of the bushing. The sealing screw member 12 has a thread 12*a* corresponding to the internal thread 11*c* in the bushing. Member 12 has an internal hexagonal opening 12*b* located along the axis of the bushing with the hexagonal opening extending through a collar 12*c* into the body of the screw member 12. The collar 12*c* rests against the shoulder surface 11*e* adjacent the second end of the bushing 11. Due to the leading end of the sealing screw member 12, the ball 13 is rotatively captured with low axial play in a receiving space 11*f* located within the bore extending through the bushing 11, with the receiving space located between the leading end of the thread 11*c* and the trailing end of the thread 11*b*.

In FIG. 4, an anchor element in the form of an anchor rod 15 is threaded into the threaded bore 11*b* of the bushing 11 until the trailing end of the rod comes into contact with the ball 13. As a result, ball 13 forms an axial stop for the anchor rod 15. Ball 13 has a point-shaped contact with the sealing screw member 12 at one end of the receiving space (11*f*) and with the trailing end of the anchor rod 15 at the other end of the receiving space. The frictional force developed when the installation tool 11 is tightened onto the anchor rod 15 is kept quite small. After placing or setting the anchor rod 15, the installation tool or bushing 11 can be easily unscrewed from the rod.

As shown in FIG. 4, the second end or hexagonal surface 11*a* of the bushing 11 is inserted into a corresponding hexagonal opening 7*a* in an adapter 7. If the dimensions of the hexagonal surface 11*a* and the hexagonal head 1*a* are the same, the same adapter 7 can be utilized for installing anchor sleeves 5 as well as anchor rods 15. Furthermore, in bushings 11 with different diameters, threaded bores 11*b* can be used for the installation of anchor rods 15 of different diameters. At its leading end, anchor rod 15 has a conically shaped tip 15*a*.

For further reduction of the friction and, thus, the frictional force, a grease cushion can be provided within the receiving space 2*a*, 11*f* of the installation tool surrounding the balls 3, 13 so that, as the balls 3, 13 turn, their entire surfaces are lubricated with grease.

While specific embodiments of the invention have been shown and described in detail to illustrate the application of the inventive principles, it will be understood that the invention may be embodied otherwise without departing from such principles.

We claim:

1. Installation tool for placing anchor elements, said tool extending axially and having a first end and a second end spaced apart in the axial direction with the first end facing in the installation direction and the second end facing in the opposite direction, said tool having a first thread extending in the axial direction and located adjacent the second end, said first thread corresponding to a thread on an anchor element to be installed, and stop means for limiting the threaded engagement of said installation tool with the anchor element, wherein the improvement comprises means within said installation tool for forming a receiving space, said stop means comprises a ball located within said receiving space in said installation tool with the receiving space being open in the installation direction and extending in the axial direction of said installation tool for a dimension smaller than the diameter of said ball.

2. Installation tool, as set forth in claim 1, wherein said receiving space having an opening facing toward the first end of said installation tool with the opening being smaller than the diameter of said ball.

3. Installation tool, as set forth in claim 2, wherein said ball is rotatably supported in said receiving space.

4. Installation tool, as set forth in claim 1, wherein said installation tool comprises an axially extending bolt-like member and said first thread comprises an external thread spaced from the first end thereof, and said receiving space located at the first end of said bolt-like member.

5. Installation tool, as set forth in claim 4, wherein an axially extending sleeve is secured to the first end of said bolt-like member with the sleeve projecting outwardly from the first end of said bolt-like member and forming the first end of said bolt-like member and forming the receiving space 2*a* for said ball.

6. Installation tool for placing anchor elements, said tool extending axially and having a first end and a second end spaced apart in the axial direction with the first end facing in the installation direction and the second end facing in the opposite direction, said tool having a first thread extending in the axial direction and located between the first and second ends, said first thread corresponding to a thread on an anchor element to be installed, and stop means for limiting the threaded engagement of said installation tool with the anchor element, wherein the improvement comprises means within said installation tool for forming a receiving space, said stop means comprises a ball located within said receiving space in said installation tool with the receiving space being open in the installation direction and extending in the axial direction of said installation tool for a dimension smaller than the diameter of said ball, said installation tool comprises an axially extending bolt-like member and said first thread comprises an external thread spaced from the first end thereof, and said receiving space located at the first end of said bolt-like member.

* * * * *